US008330587B2

(12) United States Patent
Kupstas

(10) Patent No.: US 8,330,587 B2
(45) Date of Patent: Dec. 11, 2012

(54) METHOD AND SYSTEM FOR THE IMPLEMENTATION OF IDENTIFICATION DATA DEVICES IN THEME PARKS

(76) Inventor: Tod Anthony Kupstas, Drexel Hill, PA (US)

( * ) Notice: Subject to any disclaimer, the term of this patent is extended or adjusted under 35 U.S.C. 154(b) by 1149 days.

(21) Appl. No.: 12/164,330

(22) Filed: Jun. 30, 2008

(65) Prior Publication Data

US 2009/0009294 A1 Jan. 8, 2009

Related U.S. Application Data

(60) Provisional application No. 60/948,000, filed on Jul. 5, 2007.

(51) Int. Cl.
*G08C 19/12* (2006.01)

(52) U.S. Cl. ..... 340/13.26; 340/10.1; 472/128

(58) Field of Classification Search ..... 340/10.1, 340/10.2, 10.3, 13.26; 472/128
See application file for complete search history.

(56) References Cited

U.S. PATENT DOCUMENTS

| | | | |
|---|---|---|---|
| 3,707,055 | A | 12/1972 | Pearce |
| 3,997,156 | A | 12/1976 | Barlow et al. |
| 4,063,111 | A | 12/1977 | Dobler et al. |
| 4,282,681 | A | 8/1981 | McCaslin |
| 4,296,929 | A | 10/1981 | Meyer et al. |
| 4,412,205 | A | 10/1983 | Von Kemenczky |
| 4,678,450 | A | 7/1987 | Scolari et al. |
| 4,858,930 | A | 8/1989 | Sato |
| 4,891,032 | A | 1/1990 | Davis |
| 4,967,321 | A | 10/1990 | Cimock |
| 5,036,442 | A | 7/1991 | Brown |
| 5,114,155 | A | 5/1992 | Tillery et al. |
| 5,114,344 | A | 5/1992 | Fumagalli et al. |
| 5,236,200 | A | 8/1993 | McGregor et al. |
| 5,320,358 | A | 6/1994 | Jones |
| 5,356,343 | A | 10/1994 | Lovetere |
| 5,365,214 | A | 11/1994 | Angott et al. |
| 5,482,510 | A | 1/1996 | Ishii et al. |
| 5,498,002 | A | 3/1996 | Gechter |
| 5,550,721 | A | 8/1996 | Rapisarda |
| 5,651,049 | A | 7/1997 | Easterling et al. |
| 5,655,053 | A | 8/1997 | Renie |
| 5,674,128 | A | 10/1997 | Holch et al. |
| 5,751,273 | A | 5/1998 | Cohen |
| 5,757,305 | A | 5/1998 | Xydis |
| 5,785,592 | A | 7/1998 | Jacobsen |
| 5,810,666 | A | 9/1998 | Mero et al. |
| 5,811,896 | A | 9/1998 | Grad |
| 5,830,065 | A | 11/1998 | Sitrick |
| 5,835,576 | A | 11/1998 | Katz |
| 5,836,817 | A | 11/1998 | Acres et al. |
| 5,851,149 | A | 12/1998 | Xidos et al. |
| 5,853,332 | A | 12/1998 | Briggs |
| 5,855,483 | A | 1/1999 | Collins et al. |
| 5,865,680 | A | 2/1999 | Briggs |
| 5,924,695 | A | 7/1999 | Heykoop |

(Continued)

*Primary Examiner* — Albert Wong
*Assistant Examiner* — Rufus Point
(74) *Attorney, Agent, or Firm* — Tod A. Kupstas

(57) ABSTRACT

A method and system for providing enhanced interactivity and immersion in a theme park environment. The system uses a token having a tag that is able to communicate with a reader that is associated with a theme park device. The tag communicates to the reader identification data that correlates to the theme of the theme park and the theme park device. The theme park device will act or behave in response to the identification data.

18 Claims, 6 Drawing Sheets

U.S. PATENT DOCUMENTS 5,942,969 A 8/1999 Wicks
5,946,444 A 8/1999 Evans et al.
5,964,660 A 10/1999 James et al.
5,996,033 A 11/1999 Chiu-Hao
6,009,458 A 12/1999 Hawkins et al.
6,012,984 A 1/2000 Roseman
6,025,830 A 2/2000 Cohen
6,075,443 A 6/2000 Schepps et al.
6,150,947 A 11/2000 Shima
6,162,123 A 12/2000 Woolston
6,200,216 B1 3/2001 Peppel
6,210,287 B1 4/2001 Briggs
6,220,965 B1 4/2001 Hanna et al.
6,234,803 B1 5/2001 Watkins
RE37,220 E 6/2001 Rapisarda et al.
6,254,101 B1 7/2001 Young
6,273,425 B1 8/2001 Westfall et al.
6,283,871 B1 9/2001 Briggs
6,302,793 B1 10/2001 Fertitta, III et al.
6,329,648 B1 12/2001 Delatorre
6,330,427 B1 12/2001 Tabachnik
6,352,478 B1 * 3/2002 Gabai et al. ..... 463/42
6,371,375 B1 4/2002 Ackley et al.
6,375,578 B1 4/2002 Briggs
6,404,409 B1 6/2002 Solomon
6,409,379 B1 6/2002 Gabathuler et al.
6,414,589 B1 7/2002 Angott et al.
6,463,257 B1 10/2002 Woods
6,490,409 B1 12/2002 Walker
6,494,457 B2 12/2002 Conte et al.
6,526,158 B1 * 2/2003 Goldberg ..... 382/115
6,551,188 B2 4/2003 Toyama et al.
6,626,728 B2 9/2003 Holt
6,629,019 B2 * 9/2003 Legge et al. ..... 700/237
6,632,142 B2 10/2003 Keith
6,634,949 B1 10/2003 Briggs et al.
6,682,074 B2 1/2004 Weston
6,709,336 B2 3/2004 Siegel et al.
6,761,637 B2 * 7/2004 Weston et al. ..... 463/42
6,873,260 B2 * 3/2005 Lancos et al. ..... 340/573.1
6,967,566 B2 * 11/2005 Weston et al. ..... 340/323 R
7,029,400 B2 * 4/2006 Briggs ..... 472/128
7,030,765 B2 * 4/2006 Giraldin et al. ..... 340/573.1
7,100,053 B1 * 8/2006 Brown et al. ..... 713/185
7,298,271 B2 * 11/2007 Sprogis ..... 340/572.1
7,398,921 B2 * 7/2008 Zito, Jr. ..... 235/381
7,445,550 B2 * 11/2008 Barney et al. ..... 463/37
7,477,841 B2 * 1/2009 Yamaguchi et al. ..... 396/56
7,652,824 B2 * 1/2010 Ayala et al. ..... 359/629
7,674,184 B2 * 3/2010 Briggs et al. ..... 472/128
7,734,644 B2 * 6/2010 Gras ..... 707/770
7,739,925 B2 * 6/2010 Foster ..... 73/865.8
7,749,089 B1 * 7/2010 Briggs et al. ..... 472/136
7,765,128 B2 * 7/2010 Brooks et al. ..... 705/26.1
7,788,215 B2 * 8/2010 Trowbridge et al. ..... 707/602
7,857,704 B2 * 12/2010 Henry et al. ..... 472/128
7,963,835 B2 * 6/2011 Jessop et al. ..... 463/9
8,057,306 B2 * 11/2011 Glassman et al. ..... 463/42
2001/0034257 A1 * 10/2001 Weston et al. ..... 463/1
2001/0039206 A1 11/2001 Peppel
2002/0034978 A1 * 3/2002 Legge et al. ..... 463/25
2002/0052238 A1 5/2002 Muroi
2002/0058459 A1 5/2002 Holt
2002/0158751 A1 10/2002 Bormaster
2002/0193047 A1 12/2002 Weston
2003/0069077 A1 4/2003 Korienek
2003/0106455 A1 6/2003 Weston
2003/0107178 A1 6/2003 Weston
2003/0144047 A1 7/2003 Sprogis
2003/0174049 A1 * 9/2003 Beigel et al. ..... 340/10.42
2003/0193572 A1 10/2003 Wilson et al.
2004/0081313 A1 4/2004 McKnight et al.
2004/0092311 A1 * 5/2004 Weston et al. ..... 463/42
2004/0204240 A1 10/2004 Barney
2005/0027828 A1 * 2/2005 Yamazaki ..... 709/219
2007/0066396 A1 * 3/2007 Weston et al. ..... 463/39
2008/0001707 A1 * 1/2008 Urben et al. ..... 340/5.62
2009/0063205 A1 * 3/2009 Shibasaki ..... 705/5

* cited by examiner

METHOD AND SYSTEM FOR THE IMPLEMENTATION OF IDENTIFICATION DATA DEVICES IN THEME PARKS

This Application claims the benefit of Provisional Application No. 60/948,000, filed Jul. 5, 2007, the contents of which are incorporated herein.

FIELD OF THE INVENTION

This invention relates to the field of theme parks. In particular, the invention relates to a method and system for implementing devices that can communicate between themselves and others within theme parks.

BACKGROUND OF THE INVENTION

Theme parks have traditionally provided a variety of ways to entertain the hearts and minds of children and adults alike. Many of the world's most entertaining theme parks have innovated and transformed the way we see and experience the world. Tricks of light and sound take a person from their mundane surroundings and transport them to another world, time or place.

Although, theme parks have succeeded in making the environments immersive they have come up short in making the environments fully interactive. Nothing exists that makes a person visiting the park feel as if they are truly part of the world or experience that they are visiting.

Currently there exist various technologies that permit communication with objects at a distance. For example, RFID technology generally uses cheap transmitters in order to provide information to readers. FIG. 1 shows a prior art system illustrating a basic RFID (Radio Frequency Identification) system 100. The RFID system 100 has a tag 8, and an RFID reader 10. There is variety of different types of RFID tags. Active RFID tags are RFID tags that contain a battery and can transmit data to a reader. Passive RFID tags are RFID tags that do not contain a battery and cannot transmit data unless interrogated by an RFID reader. There are also combinations of the two types of tags, called semi-passive tags, which have some battery power but do not actively transmit signals to the RFID readers, instead they can be awoken by a signal from the reader 10. RFID tags can be write-read or read only RFID devices. The RFID system 100 shown in FIG. 1 is using a passive tag 8 which is capable of transmitting data to the RFID reader 10, which can act as both a transceiver and receiver.

In the prior art system shown in FIG. 1, the RFID reader 10 sends a radio frequency signal 7 to the passive RFID tag 8 from the antenna 12 in order to interrogate it. The signal 7 is received by the tag 8 through the antenna 14. This activates the tag 8 so that it can respond to the reader 10 with the information from the tag 8. The tag 8 transmits information back to the reader 10. In this way the RFID reader 10 operates as a data collection device by receiving data from the RFID tags 8. Typically the data received is simply identification data that indicates to the reader 10 that the tag 8 is there and also provide identification information, such as a serial number.

Another form of technology that enables communication over a limited distance is Bluetooth technology. Bluetooth is an open specification for seamless wireless short-range communications of data and voice between both mobile and stationary devices. For instance, it specifies how mobile phones, computers and PDAs interconnect with each other, with computers, and with office or home phones. Although these types of technologies have been around for awhile they have not been employed to their fullest extent and potential with respect to the interactive and immersive environment of theme parks.

Therefore there is a need in the field to make theme parks more immersive and interactive through the usage of devices that enable the communication of data over a distance.

SUMMARY OF THE INVENTION

An aspect of the present invention can be a system for an interactive theme park devices comprising: a theme park device operably connected to a reader and a controller; a token having a tag, said tag adapted to transmit a signal having predetermined data to said reader, wherein said reader is adapted to send the predetermined data to the controller and the controller activates the theme park device in response to the predetermined data.

Another aspect of the invention can be a method for providing an interactive theme park experience comprising: providing a person a token having a tag with predetermined identification data selected from a plurality of predetermined identities; programming predetermined responses into a plurality of theme park devices, wherein said predetermined responses correspond to said plurality of predetermined identities; transmitting from said tag to one of said plurality of theme park devices said predetermined identification data; and activating said at least one of said plurality of theme park devices upon receipt of said predetermined identification data.

Yet another aspect of the invention can be a method for providing an interactive theme park experience comprising: providing a person a token having a tag with predetermined identification data; programming predetermined responses into a plurality of theme park devices, wherein said predetermined responses correspond to said plurality of predetermined identification data; transmitting from said tag to a reader operably connected to one of said plurality of theme park devices said predetermined identification data; and activating said at least one of said plurality of theme park devices upon receipt of said predetermined identification data.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

Figure 1:
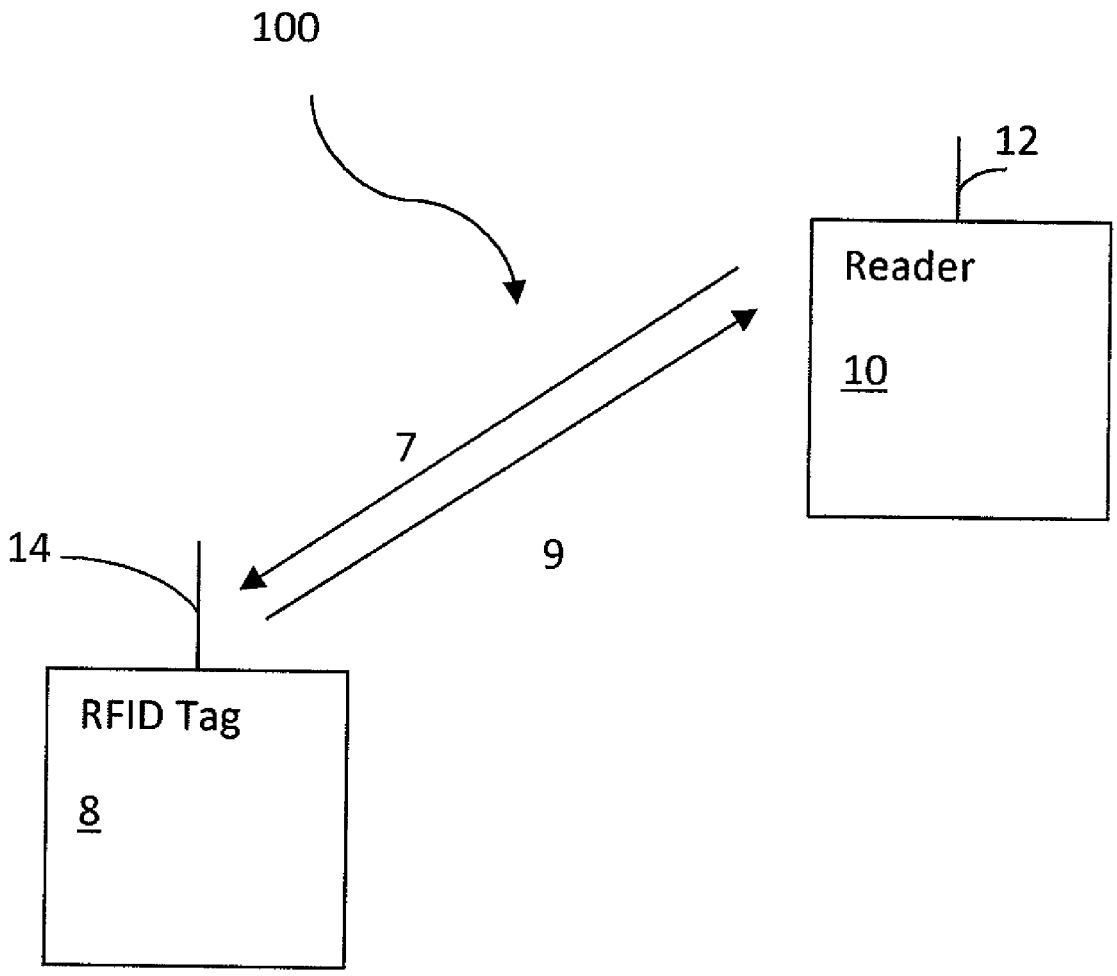
FIG. 1 Prior Art
FIG. 1 shows a prior art RFID system.
Figure 2:
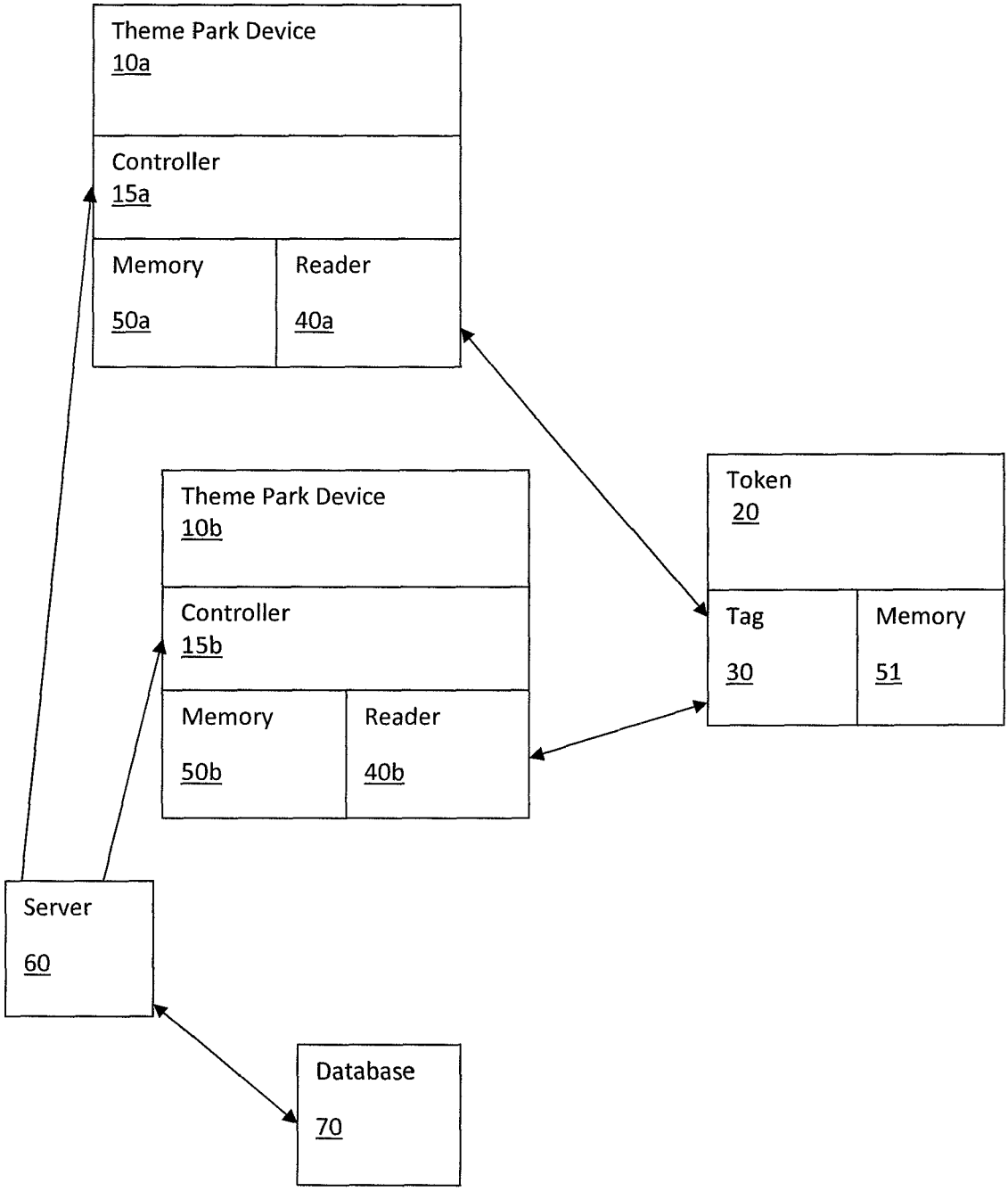
FIG. 2 is a diagram of a system, in accordance with an embodiment of the present invention.

Referring to FIG. 2, a component diagram of an exemplary system in accordance with an embodiment of the present invention is shown. The system comprises a token 20, having a tag 30 that has a memory 51. Also shown in the system of FIG. 2 are two theme park devices 10*a*, 10*b*, each having a reader 40*a*, 40*b*, having a controller 15*a*, 15*b*, and a memory 50*a*, 50*b*. In the embodiment shown, server 60 is in communication with the controllers 50*a*, 50*b*, located at the theme park devices 10*a*, 10*b*and with a database 70. The components of this system will now be discussed in detail below.

The token 20 may be an article that can be carried or an article that may be worn by an individual. Some examples may be hats, pins, scarves, ties, shirts, pants, shorts, undergarments, robes, shoes, wands, talisman, guns, swords, books, stuffed animals, necklace, ring, key chains, etc. It is possible that the token 20 may be a ticket or similar park related item. Preferably the token 20 is associated with the theme of the park. By having the token 20 taken from the thematic universe of the theme park a greater sense of immersion can be achieved. For example, in a Harry Potter themed park people entering the park may be given a scarf, a tie or some other piece of clothing taken from the garb worn by the students. Alternatively, they may be given a wand or some talisman taken from the content of the stories. As another example, in a Disney theme park people entering the park may be given pins showing a character from the pantheon of Disney movies, or they may be given a hat that has the tag 30 placed therein.

The tag 30 is placed in or on the token 20. The tag 30 may be an active RFID tag, a passive RFID tag, a semi-passive RFID tag, a Bluetooth enabled device, an infra-red device, or an optical device. The tag 30 communicates with the readers 40*a*, 40*b*, located at the theme park devices 10*a*, 10*b*. The tag 30 has a memory 51 that is able to save the identification data that is predeterminedly placed thereon.

When using a Bluetooth enabled tag 30 it is contemplated that the token 20 may be able to communicate with other common devices used by an individual, for example a Bluetooth enabled cell phone. As discussed above in the background, Bluetooth is a wireless protocol utilizing short-range communications technology facilitating data transmissions over short distances from fixed and/or mobile devices, creating wireless personal area networks (PANs). These localized networks can enable the formation of localized networks between the tag 30 and the readers 40*a* and 40*b* and be used in order to facilitate the immersive experiences.

The identification data that is stored in the memory 51 is typically data that is associated with the theme of the park. For example, in a Harry Potter theme park the identification data may be related to a specific character from the stories or to one of the houses that are part of the school. The identification data may be stored on the memory 51 that is part of a token 20 that is indistinguishable from other tokens 20, such as a wand. In other words the appearance of the tokens 20 may appear uniform, but the identification data stored in the memory 51 may be unique, or vary among certain select identities. When used with certain theme park devices 10*a*, 10*b*, the identity stored in the token 20 would be revealed. For example when using a Harry Potter themed token 20 it may be revealed which house one is member of when approaching the park devices 10*a*, 10*b*.

Another example may involve the usage of a Disney themed token 20 that may store the various character identification data in the memory 51. It is also contemplated that the identification data may be pre-selected by a person prior to entering the park. It is further contemplated that in some instances the memory 51 may be programmed with personal information from the person entering the park so as to have a more personalized experience when experiencing the park. Some examples may be birthday information, name, favorite character, favorite book, movie, game, etc. This personalized data may be combined with pre-determined data already stored in the memory 51 so as to provide a more complete and immersive experience.

In addition to the memory 51 having predetermined identification data stored thereon it may also be possible to have additional data written to the memory 51. The additional data may be provided from the readers 40*a*, 40*b* and may log which theme park devices 10*a*, 10*b* have been interacted with or visited. Other data such as food eaten, beverages drank, or identification data of other tokens 20 may be stored in the memory 51.

The theme park devices 10*a*, 10*b* may be any device that is capable of responding to or interacting with a person. Some example of theme park devices 10*a*, 10*b*, may be rides, displays, animatronics or robotic devices, sound systems, doors, walls, windows, floors, ceilings and/or other park related equipment and devices.

Located on or within the theme park device 10*a* is the reader 40*a*, controller 15*a* and the memory 50*a*. The reader 40*a*transmits to and receives signals from the tag 30. The received and transmitted signals are of the type associated and appropriate for communication with the tag 30, e.g. RF signals, Bluetooth protocol enabled signals, etc. The identification data received by the reader 40*a* is then transmitted to the controller 15*a*. The controller 15*a* may be a processor, microprocessor, array of processors and/or networked system of processors. The controller 15*a* processes the signal and retrieves the context responsive instructions from the memory 50*a*. The memory 50*a* stores the behavioral instructions associated with the identification. The controller 15*a* activates the machinery, electronics, lights, sounds, etc. that performs the proper behavior based upon the identification data. It is also possible for the memory 50*a* to store additional information, such as logging which identification data that the theme park device 10*a* receives, the number of persons who triggered the theme park device 10*a*, the date, time and duration of triggering events. Theme park device 10*b*, reader 40*b*, controller 15*b* and memory 50*b* perform in the same fashion as theme park device 10*a*, reader 40*a*, controller 15*a* and memory 50*a* discussed above.

Also shown in FIG. 2 is a server 60 and database 70. The server 60 is operably connected to the controllers 50*a* and 50*b* of the theme park devices 10*a*, 10*b*. The server 60 may be connected either via wires and/or wirelessly, or may be part of wider global network. In the embodiment shown in FIG. 2, the server 60 retrieves data from the database 70. The server 60 may be used to retrieve data in order to update the memories 50*a*, 50*b* of the theme park devices 10*a*, 10*b*, so as to provide new instructional material related to the identification data stored in the tag 30 of the token 20.

Updated instructional material may include current and future thematic material, new responses for the theme park devices 10*a*, 10*b*, an updated list of tokens 20 in the park and corresponding predetermined identification data and time contextual material, such as birthdays, seasonal events, time of day, etc. Updated material may be predetermined. It should be understood that it is also possible that the predetermined identification data includes personal information of the person as well as character identities. The server 60 may be able to quickly transmit this information to each of the theme park devices 10*a*, 10*b*, so as to avoid manually reprogramming each device. Server 60 may also receive information from the controllers 15*a*, 15*b* related to the number of times activated and the identification data that it has received. It may also provide maintenance information back to the server 60 when provided with self-diagnostic capabilities.

Figure 3:
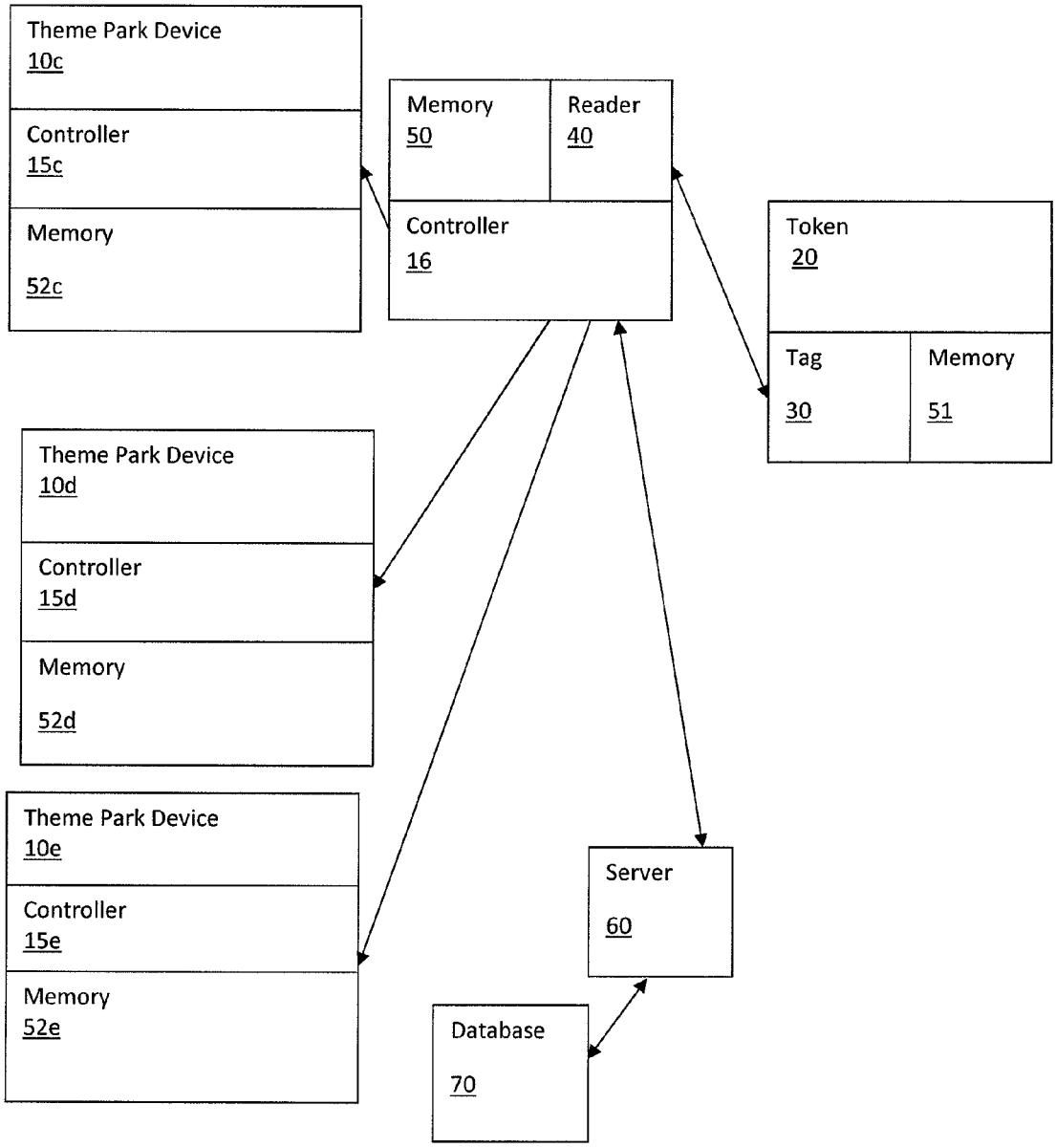
FIG. 3 is a diagram of a system, in accordance with an embodiment of the present invention.

Now referring to FIG. 3, wherein a different arrangement of the components discussed above with respect to FIG. 2 is shown. The exemplary system shown in FIG. 3 uses one memory 50, reader 40 and controller 15 in order to control a number of theme park devices 10*c*, 10*d*, and 10*e*. The theme park devices 10*c*-10*e*, each has a controller 15*c*-15*e* and a memory 52*c*-52*e*. In the embodiment shown, the token 20 has a tag 30 and a memory 51. The tag 30 sends a signal to the reader 40 when interrogated, or alternatively the tag 30 may be continuously broadcasting a signal, in which case the reader 40 simply receives the transmitted signal when in range.

Still referring to FIG. 3, the controller 16, which is operably connected to the reader 40 and the memory 50 is also capable of transmitting a signal to controllers 15*c*-15*e*, which in turn control and activate theme park devices 10*c*-10*e*. Theme park devices 10*c*-10*e* via the controllers 15*c*-15*d* are also capable of retrieving additional instructional material from the memories 52*c*-52*e*. The controller 16 is able to provide the identification data and any accompanying instructions to each of the theme park devices 10*c*-10*e* which are then able to act in concert in response to the presence of the token 20. This arrangement of having one reader 40 being able to send the identification data to multiple theme park devices 10*c*-10*e* permits an efficient usage of the equipment, thereby saving costs in providing a reader 40 to each theme park device 10*c*-10*e*. This arrangement is preferably established in locations that have limited access and/or in established sets.

For example if the person carrying the token 20, say a person whose identification data indicates that she is Snow White, enters into a set piece having multiple theme park devices 10*c*-10*e*, for example animatronic dwarves who are able to respond to the character who the person is identified as, each of the theme park devices 10*c*-10*e* need only be in communication with the controller 16, which can provide the identification data to each of the controllers 15*c*-15*e*, which then in turn retrieve instructions from the memories 52*c*-52*e*. In the aforementioned example, the dwarves may receive the identification data that Snow White has entered the room and the dwarves may start singing a specific song in response. Should the identification data indicate that the person entering the room is another dwarf, or the witch, yet another song and series of animations may occur. Should another character enter, say Donald Duck, yet a totally different set of songs and animations may occur.

The server 60 and the database 70 operate in the same fashion as disclosed above with respect to the system shown in FIG. 3. However, in the system shown in FIG. 3 the server 60 can provide instructional sets that will alter the behavior of groups of theme park devices as well as individual devices.

Figure 4:
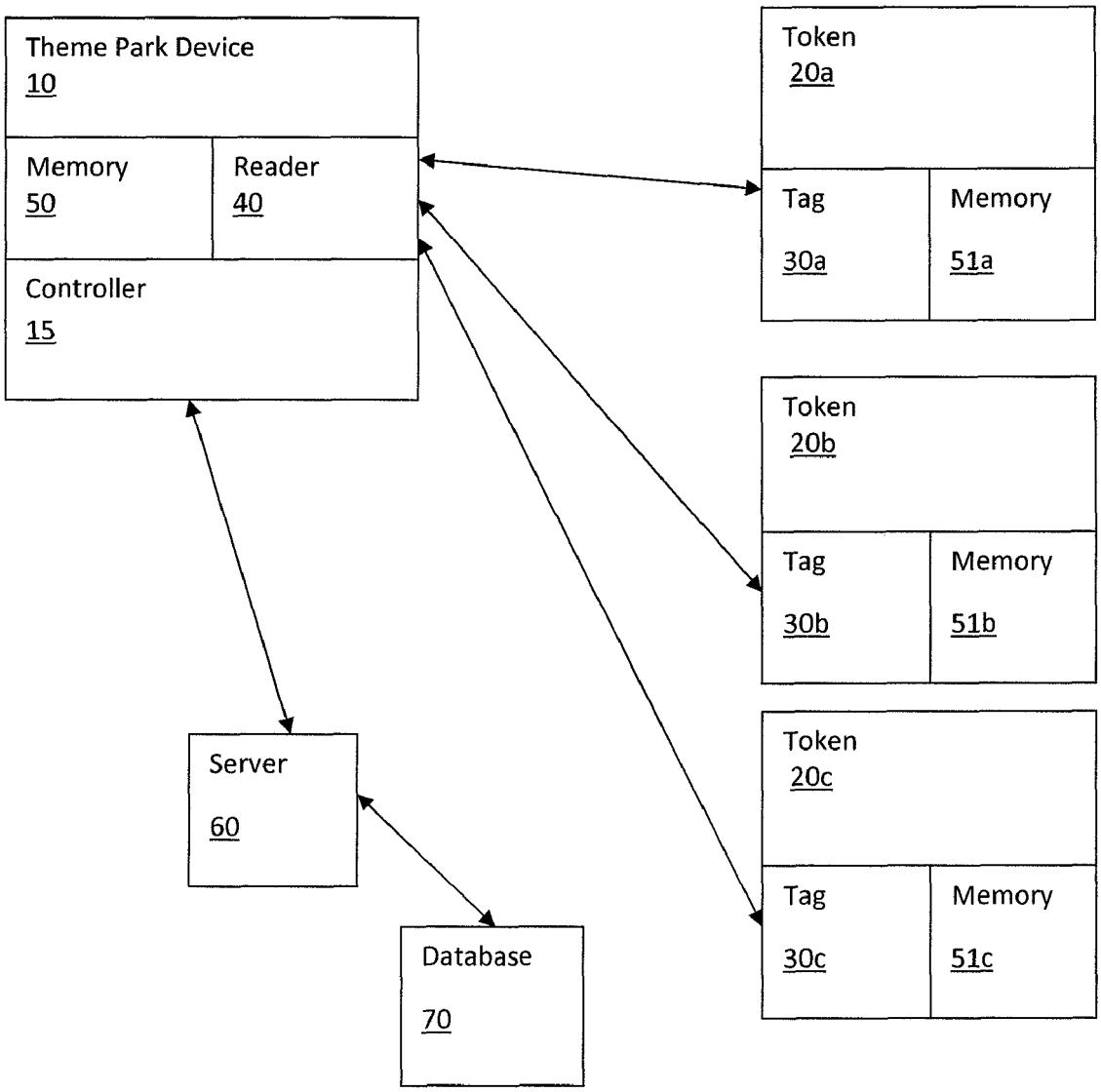
FIG. 4 is a diagram of a system, in accordance with an embodiment of the present invention.

Now referring to FIG. 4, wherein a different arrangement of the components discussed above with respect to FIGS. 2 and 3 is shown. The exemplary system shown in FIG. 4 uses one theme park device 10, a memory 50, a reader 40 and a controller 15 and receives incoming signals from a plurality of tokens 20*a*, 20*b* and 20*c*, having tags 30*a*-30*c* and memories 51*a*-51*c*. In the system shown in FIG. 4 the tags 30*a*-30*c* send their identification data to the reader 40 upon being interrogated by the reader 40. The theme park device 10 may log the received identification in the memory 50 and provide a response based upon the number and types of identification data received. The theme park device 10 may be programmed to only have a response when a certain number of signals from tags are received.

Figure 5:
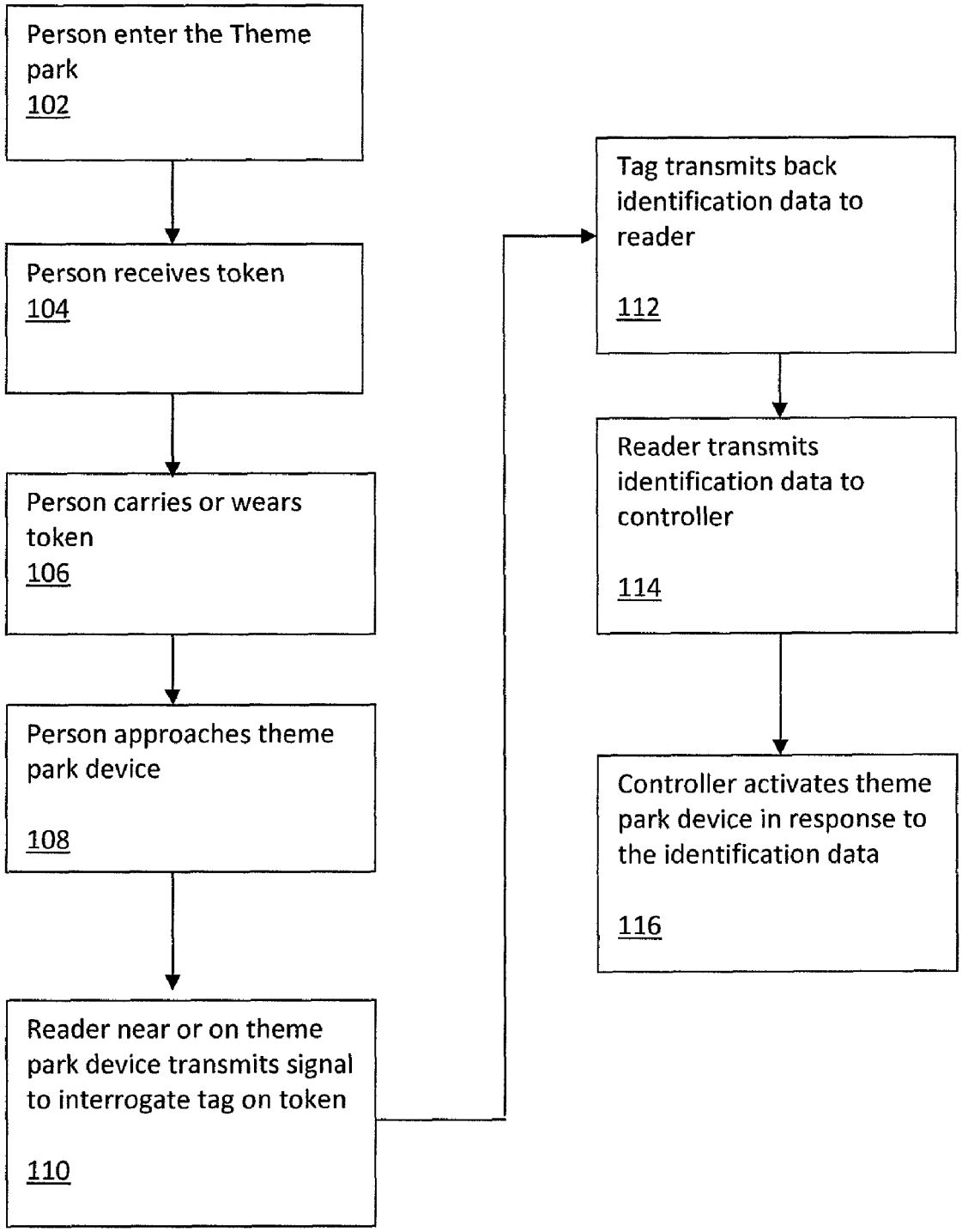
FIG. 5 is flow chart of the steps used in a method of using a token, in accordance with an embodiment of the present invention.

FIG. 5 is flow chart illustrating a method of practicing the present invention. At step 102 a person enters the theme park. At step 104 the person receives a token 20. The token 20 may be handed to the person upon the purchasing of a ticket or may be part of additional fare added to the ticket price, or received at some location other than the entrance to the park. The person may also receive the token 20 prior to entering the park, through a pre-ordering system, either via mail or via the Internet, or alternatively the person may receive the token 20 when entering the park. Prior to being provided the token 20, the person may fill out personal information in order to elicit more personalized responses from theme park devices 10. This information may then be entered into the memory 51 located on the tag 30 in order to create a unique identity for the tag 30. Additionally identification data related to characters related to the theme of the park are stored in the memory 51. In some instances some of the character identities stored on the token 20 may be rare with respect to the visitors in the park and the person who has that specific token 20 may receive special treatment.

At step 106 the person carries or wears the token 20. As noted above in discussing the tokens 20, the token 20 may be any sort of talisman, article of clothing or object. Preferably the token 20 that is carried or worn is thematic in nature and related to the theme of the park or the characters in the universe of the park.

At step 108 a person approaches a theme park device 10. This can occur by casually passing a theme park device 10. Approaching an entrance way that is a theme park device 10, by getting on a ride that is a theme park device 10 and/or any other activity that one performs in the general course of visiting a theme park. For instance the theme park device 10 may also be placed in eateries, at food stands, in gifts shops, etc. Special responses and/or discounts may be provided to persons having certain tokens 20.

At step 110 the reader 40 located near or on the theme park device 10 may interrogate the tag 30 located on the token 20. At step 112 the tag 30 communicates back to the reader 40 the identification data that is stored in the memory 51 and/or otherwise stored on the tag 30. At step 114, the reader 40 will transmit the identification data to the controller 15 that initiates and controls the actions of the theme park device 10. At step 116, the controller 15 activates the theme park device 10 and has it perform an activity or behavior that corresponds and/or is related to the identification data that it has received.

An example of this will now be provided. In the universe of Harry Potter there are four houses in which students may be placed. These houses are selected by having the student put a sorting hat on their head. In a Harry Potter themed park a person would receive at the ticket booth some sort of token 20. For instance a scarf, a book, a robe, a wand, etc. i.e. something related to the overall themes in the book. The person may choose to place the sorting hat on their head and at that time the sorting hat will announce which house the person belongs to based upon the identification stored in the token 20. It may even be possible that the person is a famous character from that particular universe and through the interactions with various theme park devices 10 his or her identity may be revealed.

Figure 6:
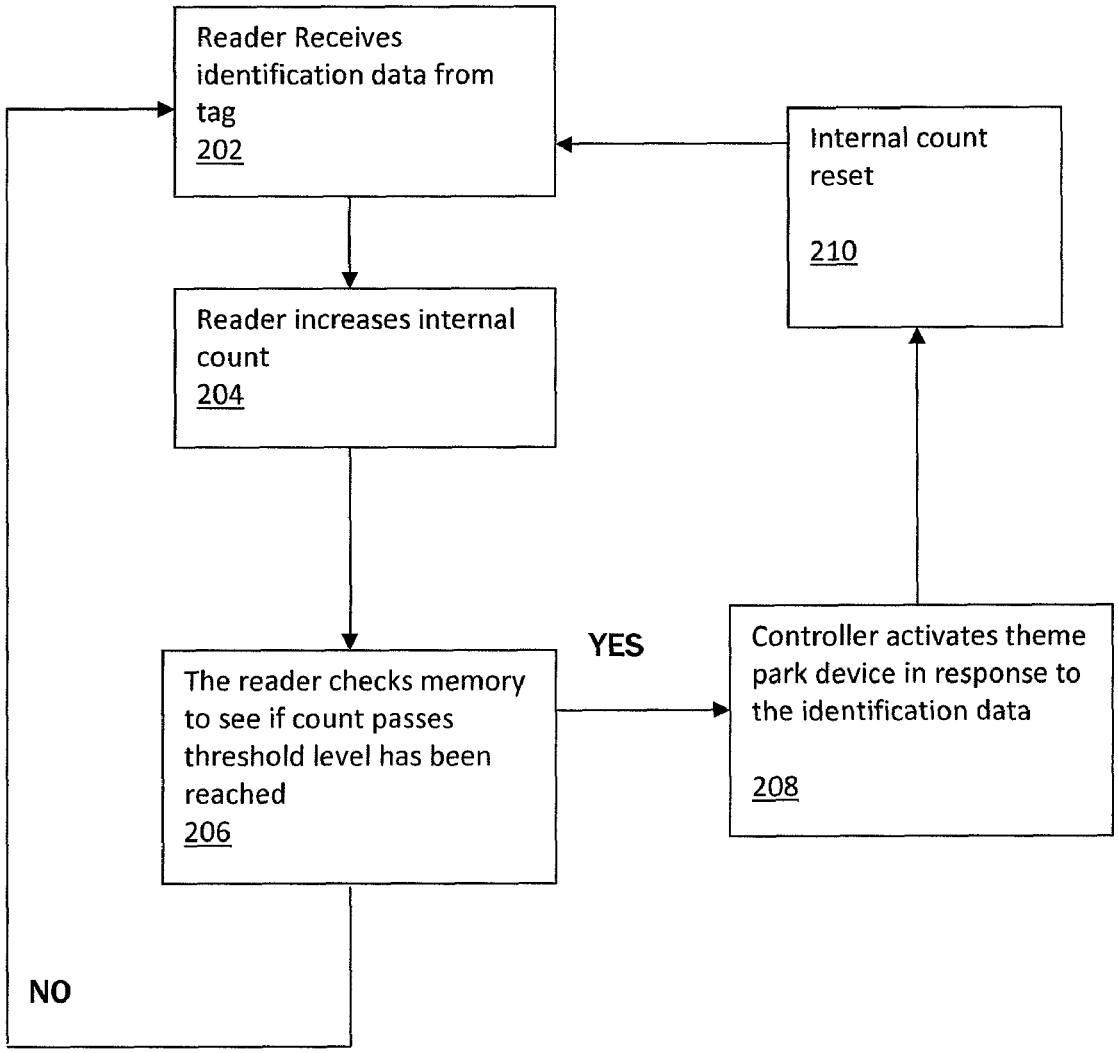
FIG. 6 is a flow chart of the steps used in a method of using a token, in accordance with an embodiment of the present invention.

FIG. 6 illustrates another method that may be performed in accordance with the present invention. At step 202 a reader 40 receives identification data from a tag 30 that is part of the token 20. At step 204 the reader 40 increase an internal count that is being stored in its memory 50. At step 206 the reader 40 polls the memory 50 in order to determine if the count received passes a predetermined threshold level. This polling may also be performed by the controller 15. If the answer is yes, at step 208 the controller 15 will activate the theme park device 10 in response to the identification data. After performing the activity, at step 210 the internal count will be reset. If the answer is no the system will continue to keep increasing the internal count.

It is also contemplated that in addition to having the tokens 20 communicate with readers 40 located near or on theme park devices 10 which in some embodiments the tokens 20 may interact with each other, by broadcasting a sound, lighting up or performing some other type of action such as vibration. In embodiments wherein this is the case it is contemplated that the tokens 20 would also have controller and reader capabilities in order to have these actions occur and so as to be able to associate the identification data with the appropriate response.

It is further contemplated that the tokens 20 may keep a log of activities performed by the person and may transmit this information back to the server 60 or alternatively the controllers 15 located at the theme park devices 10 may transmit this data back to the server 60. This information may be used to further improve the park or to provide future discounts and/or other incentive programs to the persons based upon their activities.

Additional embodiments of the invention may include the utilization of the tokens 20 and the data contained therein to track the location of a child in the event that the child should go missing. Centralized computers and databases may receive an alert that a child has gone missing and interactive devices could either communicate with the child when nearby or alternatively the data can be used in order to determine where the child had last been. This can be accomplished via the analysis of time stamp information.

Other improvements may be the employment of multilingual capabilities to the interactive devices. When receiving a token and/or providing information for placement upon the token it can be determined which language is going to be used. The language ID may already be pre-embedded on select tokens and or indicated upon uploading data to the token. Devices throughout the park would be able to identify the key data that indicates the preferred language and respond accordingly.

Tokens could also be used to identify statistical information such as numbers of people within a park, purchasing habits of park visitors, number of people in line at any given time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for interactive theme park devices comprising:

a theme park device operably connected to a reader and a controller and operable with a plurality of tokens;

a token having a tag, wherein said token is visually indistinguishable from the other tokens within the plurality of tokens, wherein the tag has stored thereon predetermined identification data selected from a plurality of predetermined theme park related character identities; wherein said tag is adapted to transmit a signal having predetermined identification data to said reader, wherein said reader is adapted to send the predetermined identification data to the controller and the controller activates the theme park device in response to the predetermined identification data, wherein the response is determined by the predetermined theme park related character identity; wherein different character identity related responses correspond to different predetermined theme park related character identities; and wherein the character identity is revealed, for the first time, to a person carrying the token by the predetermined response of the theme park device.

2. The system of claim 1, wherein the theme park device is selected from the group consisting of displays, animatronics or robotic devices, sound systems, doors, walls, windows, floors, and ceilings.

3. The system of claim 1, wherein the tag is an RFID tag.

4. The system of claim 1, wherein the token is a selected from the group consisting of hats, pins, scarves, ties, shirts, pants, shorts, undergarments, robes, shoes, wands, talisman, guns, swords, books, stuffed animals, necklace, ring, and key chains.

5. The system of claim 1, wherein the tag is a Bluetooth enabled device.

6. The system of claim 1, wherein the reader is operably connected to more than one theme park device.

7. The system of claim 1, wherein the controller is operably connected to a server.

8. The system of claim 1, wherein the token is one of a plurality of tokens, wherein each of the plurality of tokens is different from each other.

9. A method for providing an interactive theme park experience comprising:

providing a person a token having a tag with predetermined identification data selected from a plurality of predetermined theme park related character identities; wherein the token is selected from a group of tokens having uniform appearance;

programming predetermined responses into a plurality of theme park devices, wherein said predetermined responses are determined by said plurality of predetermined theme park related identities, wherein different character identity related responses occur for different predetermined theme park related character identities; wherein the character identity is revealed, for the first time, to the person by the predetermined response of the theme park device;

transmitting from said tag to one of said plurality of theme park devices said predetermined identification data;

activating said at least one of said plurality of theme park devices upon receipt of said predetermined identification data; and further comprising the step of updating the predetermined responses from a server.

10. The method of claim 9, wherein the step of updating is performed on a daily basis.

11. The method claim 9, further comprising transmitting to a server data related to the activities of the said plurality of theme park devices.

12. The method of claim 9, wherein said one of the plurality of theme park devices receives a predetermined threshold number of predetermined identification data before activating.

13. The method of claim 9, wherein the one of said plurality of theme park devices is selected from the group consisting of displays, animatronics or robotic devices, sound systems, doors, walls, windows, floors, and ceilings.

14. The method of claim 9, wherein a store provides a discount based upon the token.

15. The method of claim 9, wherein the tag is a blue tooth enabled device.

16. A method for providing an interactive theme park experience comprising:

providing a person a token having a tag with predetermined identification data corresponding to a theme park related character identity, wherein the token is visually indistinguishable from other tokens used within the theme park;

programming predetermined responses into a plurality of theme park devices, wherein different predetermined responses are determined by different theme park related character identities and wherein different character identity related responses occur for different predetermined theme park related character identities; wherein the character identity is revealed, for the first time, to the person by the predetermined response of the theme park device;

transmitting from said tag to a reader operably connected to one of said plurality of theme park devices said predetermined identification data; and activating said at least one of said plurality of theme park devices upon receipt of said predetermined identification data.

17. The method of claim 16, wherein the reader is operably connected to more than one theme park device.

18. The system of claim 1, further comprising a second theme park device operably connected to the reader and the controller, wherein each of the theme park devices further comprises a theme park device controller and theme park device memory; and further wherein the reader is operably connected to a server.

* * * * *